US011790879B2

(12) United States Patent
Harada et al.

(10) Patent No.: US 11,790,879 B2
(45) Date of Patent: Oct. 17, 2023

(54) IMPACT DETECTION DEVICE AND PERCUSSION INSTRUMENT

(71) Applicant: YAMAHA CORPORATION, Hamamatsu (JP)

(72) Inventors: Keizo Harada, Hamamatsu (JP); Kazuo Masaki, Hamamatsu (JP); Emi Tanabe, Hamamatsu (JP)

(73) Assignee: YAMAHA CORPORATION, Hamamatsu (JP)

( * ) Notice: Subject to any disclaimer, the term of this patent is extended or adjusted under 35 U.S.C. 154(b) by 32 days.

(21) Appl. No.: 17/171,515

(22) Filed: Feb. 9, 2021

(65) Prior Publication Data

US 2021/0256946 A1 Aug. 19, 2021

(30) Foreign Application Priority Data

Feb. 14, 2020 (JP) ..... 2020-023174

(51) Int. Cl.
*G10H 3/14* (2006.01)
*G10D 13/10* (2020.01)
*G10D 13/02* (2020.01)

(52) U.S. Cl.
CPC ..... *G10H 3/146* (2013.01); *G10D 13/02* (2013.01); *G10D 13/26* (2020.02); *G10H 3/143* (2013.01); *G10H 2220/525* (2013.01)

(58) Field of Classification Search
CPC .. G10H 3/146; G10H 3/143; G10H 2220/525; G10D 13/26; G10D 13/02
See application file for complete search history.

(56) References Cited

U.S. PATENT DOCUMENTS 6,921,857 B2 * 7/2005 Yoshino ..... G10D 13/26 84/738
2003/0061932 A1 * 4/2003 Tanaka ..... G10H 3/146 84/738
2004/0118269 A1 6/2004 Yoshino
2015/0027301 A1 * 1/2015 Shih ..... G10H 3/12 84/730
2017/0229104 A1 8/2017 Suitor
(Continued)

FOREIGN PATENT DOCUMENTS

EP 1298641 A1 4/2003
EP 3208796 A1 8/2017
(Continued)

OTHER PUBLICATIONS

Extended European Search Report issued in European Appln. No. 21156017.2 dated Jun. 9, 2021.

*Primary Examiner* — Jianchun Qin
(74) *Attorney, Agent, or Firm* — ROSSI, KIMMS & McDOWELL LLP

(57) ABSTRACT

An impact detection device includes: a body configured to be struck; a vibration sensor that detects vibration of the body; a support base that supports the vibration sensor; a first elastic body sandwiched between the vibration sensor and the body; and a second elastic body sandwiched between the vibration sensor and the support base. A dimension of each of the first elastic body and the second elastic body is smaller than a dimension of the vibration sensor when viewed from an arrangement direction in which the first elastic body, the vibration sensor, and the second elastic body are arranged.

12 Claims, 4 Drawing Sheets

(56) References Cited

U.S. PATENT DOCUMENTS

| | | | | |
|---|---|---|---|---|
| 2018/0197517 | A1* | 7/2018 | Takasaki | G10D 13/26 |
| 2018/0247631 | A1 | 8/2018 | Suitor | |
| 2020/0327872 | A1* | 10/2020 | Shemesh | G10H 3/146 |

FOREIGN PATENT DOCUMENTS

| | | | | | |
|---|---|---|---|---|---|
| GB | 2553458 | A | * | 3/2018 | G10H 1/00 |
| JP | 2007025093 | A | * | 2/2007 | |
| JP | 3933566 | B2 | | 6/2007 | |
| JP | 2016033580 | A | * | 3/2016 | |

* cited by examiner

IMPACT DETECTION DEVICE AND PERCUSSION INSTRUMENT

CROSS-REFERENCE TO RELATED APPLICATIONS

Priority is claimed on Japanese Patent Application No. 2020-023174, filed Feb. 14, 2020, the contents of which are incorporated herein by reference.

BACKGROUND OF THE INVENTION

Field of the Invention

The present invention relates to an impact detection device and a percussion instrument.

Description of Related Art

Japanese Patent Publication No. 3933566 (hereinafter referred to as Patent Document 1) discloses a percussion instrument in which a vibration sensor (piezoelectric element) for detecting vibration of a body to be struck (head) due to an impact or the like. The vibration sensor is held between the body to be struck and a support base (frame). In this percussion instrument, an elastic body (cushion material) is sandwiched between the vibration sensor and the body to be struck, and between the vibration sensor and the support base.

SUMMARY OF THE INVENTION

However, in the percussion instrument of Patent Document 1 there is a problem in that the degree of freedom of vibration of the vibration sensor is low because the movement (vibration) of the vibration sensor accompanying the impact on the body to be struck is restricted by the elastic body.

The present invention has been made in view of the above circumstances. A one object of the present invention is to provide an impact detection device and a percussion instrument that can hold the vibration sensor against the body to be struck, and improve the degree of freedom of the vibration of the vibration sensor accompanying an impact on the body to be struck.

According to a first aspect of the present invention, an impact detection device includes: a body configured to be struck; a vibration sensor that detects vibration of the body; a support base that supports the vibration sensor; a first elastic body sandwiched between the vibration sensor and the body; and a second elastic body sandwiched between the vibration sensor and the support base. A dimension of each of the first elastic body and the second elastic body is smaller than a dimension of the vibration sensor when viewed from an arrangement direction in which the first elastic body, the vibration sensor, and the second elastic body are arranged.

According to a second aspect of the present invention, a percussion instrument includes: a support member; and an impact detection device resting on the support member and including: a body configured to be struck; a vibration sensor that detects vibration of the body; a support base that supports the vibration sensor; a first elastic body sandwiched between the vibration sensor and the body; and a second elastic body sandwiched between the vibration sensor and the support base. A dimension of each of the first elastic body and the second elastic body is smaller than a dimension of the vibration sensor when viewed from an arrangement direction in which the first elastic body, the vibration sensor, and the second elastic body are arranged.

DETAILED DESCRIPTION OF THE INVENTION

Hereinafter, one embodiment of the present invention will be described with reference to FIGS. 1A, 1B, and 2.

Figure 1A:
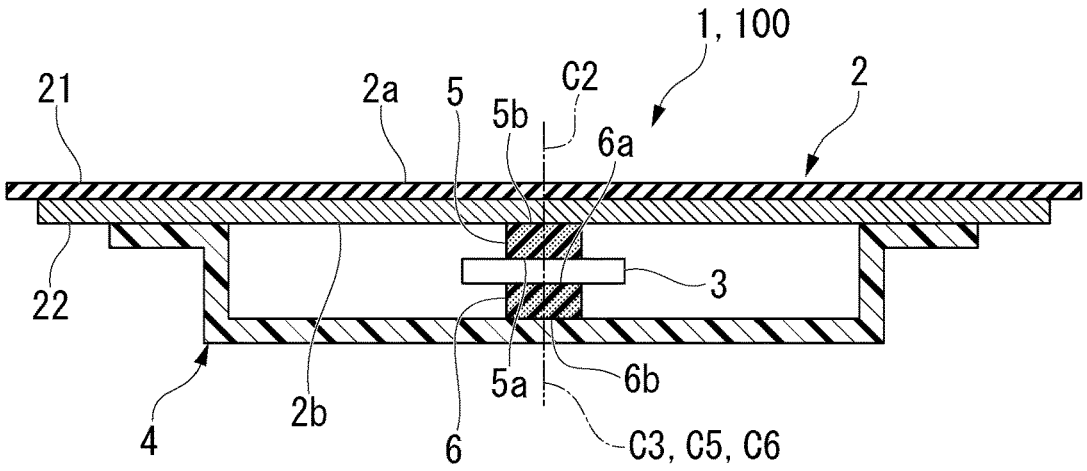
FIG. 1A is a cross-sectional view showing an outline of a percussion instrument (percussion) including an impact detection device according to one embodiment of the present invention.
Figure 1B:
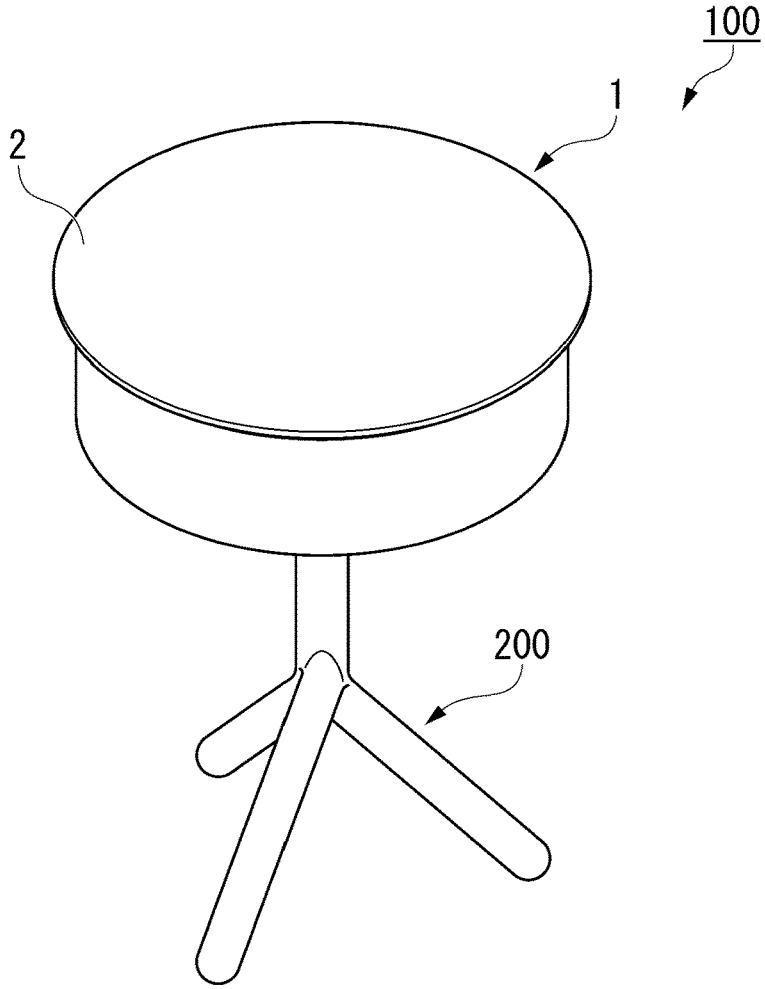
FIG. 1B is an external view of showing an outline of the percussion instrument of FIG. 1A.
Figure 2:
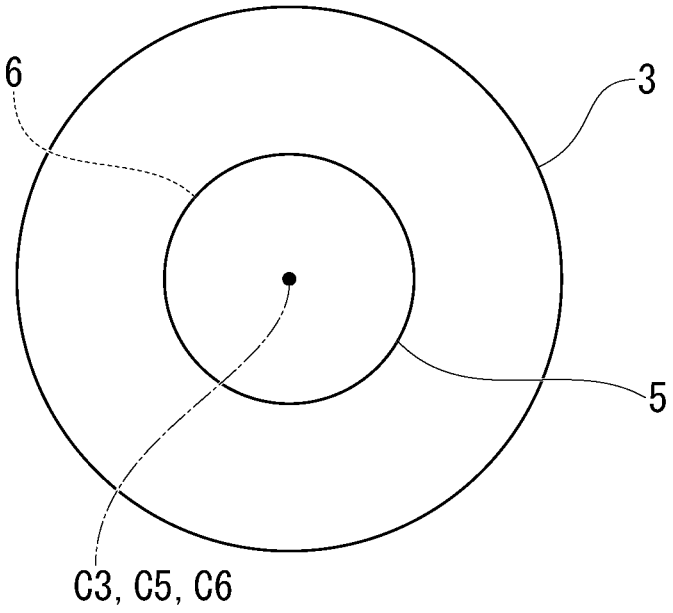
FIG. 2 is a view of a first elastic body, a vibration sensor, and a second elastic body as viewed from an arrangement direction thereof.

As shown in FIG. 1A, a percussion instrument 100 according to this embodiment is an instrument for producing a sound when struck, and includes an impact detection device 1. As shown in FIG. 1B, the percussion instrument 100 further includes a stand (support member) 200 on which the impact detection device 1 is rested. The impact detection device 1 includes a body to be struck (body to be struck) 2, a vibration sensor 3, a support base 4, a first elastic body 5, and a second elastic body 6.

The body to be struck 2 has a striking surface 2*a* that is struck by a stick or the like. The body to be struck 2 of this embodiment is formed in a plate shape. Further, the body to be struck 2 includes an elastic sheet portion 21 and a support plate portion 22 which are overlapped in the thickness direction thereof. The elastic sheet portion 21 is made of an elastic body such as silicon rubber. The support plate portion 22 has a higher elastic modulus than the elastic sheet portion 21 and is made of as a metal or the like. The striking surface 2*a* of the body to be struck 2 is formed by (the surface of) the elastic sheet portion 21. Further, a surface 2*b* (back surface 2*b*) of the body to be struck 2 facing the opposite side to the striking surface 2*a*, is formed by (the surface of) the support plate portion 22. The axis in FIG. 1A indicates the center C2 of the body to be struck 2 when the body to be struck 2 is viewed from the thickness direction of the body to be struck 2.

The shape of the body to be struck 2 seen from the thickness direction is not limited to a circular shape, but may be an arbitrary shape such as a polygonal shape. Further, the body to be struck 2 may be a head formed in a membrane shape such as a film.

The vibration sensor 3 detects the vibration of the body to be struck 2 accompanying an impact on the body to be struck 2 (that is, the vibration of the body to be struck 2 corresponding to an impact on the body to be struck 2). The vibration sensor 3 is a piezoelectric sensor that outputs an electric signal corresponding to the vibration. The vibration sensor 3 is formed in a plate shape or a membrane shape. The vibration sensor 3 may be, for example, a sensor using a polyvinylidene fluoride (PVDF) film or an electret. In this embodiment, the vibration sensor 3 is arranged on the back surface 2*b* side of the body to be struck 2. Further, the plan view shape of the vibration sensor 3 seen from the thickness direction (vertical direction in FIG. 1A) is a circular shape as shown in FIG. 2.

The vibration sensor 3 may be arranged on the striking surface 2*a* side of the body to be struck 2, for example. Further, the plan view shape of the vibration sensor 3 may be any shape such as a polygonal shape.

As shown in FIG. 1A, the support base 4 supports the vibration sensor 3 between the support base 4 itself and the body to be struck 2. In this embodiment, the support base 4 is arranged on the back surface 2*b* side of the body to be struck 2. Further, the support base 4 is formed in a bowl shape. A peripheral portion (of the bowl) of the support base 4 is fixed to the back surface 2*b* of the body to be struck 2. The vibration sensor 3 is arranged at a central portion of the support base 4. The central portion of the support base 4 is on the inside of the peripheral portion of the support base 4 and is located at a distance from the back surface 2*b* of the body to be struck 2.

The support base 4 may be, for example, a double-sided beam in which only both ends in the longitudinal direction are fixed to the body to be struck 2. In this case, the vibration sensor 3 may be arranged at a portion of the support base 4 between both ends.

The first elastic body 5 is sandwiched between the vibration sensor 3 and the body to be struck 2. The second elastic body 6 is sandwiched between the vibration sensor 3 and the support base 4. The first elastic body 5 and the second elastic body 6 sandwich the vibration sensor 3 from the thickness direction thereof. As a result, the vibration sensor 3 is held between the body to be struck 2 and the support base 4.

The elastic moduli of the first and second elastic bodies 5 and 6 are smaller than the elastic moduli of the body to be struck 2 and the support base 4. That is, the first and second elastic bodies 5 and 6 are more easily deformed elastically than the body to be struck 2 and the support base 4. The first and second elastic bodies 5 and 6 are, for example, rubber or sponge.

In this embodiment, the dimensions of the first elastic body 5 and the second elastic body 6 are equal to each other when viewed from the arrangement direction of the first elastic body 5, the vibration sensor 3, and the second elastic body 6 (vertical direction in FIG. 1A). Further, the plan-view shapes of the first and second elastic bodies 5 and 6 viewed from the arrangement direction are all circular as shown in FIG. 2. The plan-view shapes of the first and second elastic bodies 5 and 6 may be any shape such as a polygonal shape. Further, the plan-view shapes of the first and second elastic bodies 5 and 6 may be different from each other, for example.

The dimensions of the first elastic body 5 and the second elastic body 6 as seen from the arrangement direction of the first elastic body 5, the vibration sensor 3, and the second elastic body 6 are smaller than the dimension of the vibration sensor 3. It is sufficient that the dimensions of the portions of the first and second elastic bodies 5 and 6 that contact the vibration sensor 3 is at least smaller than the dimension of the surface of the vibration sensor 3 with which the first and second elastic bodies 5 and 6 come into contact.

Further, in this embodiment, the center C3 of the vibration sensor 3, the center C5 of the first elastic body 5, and the center C6 of the second elastic body 6 coincide with each other when viewed from the arrangement direction. Further, as shown in FIG. 1A, the center C3 of the vibration sensor 3 and the centers C5 and C6 of the first and second elastic bodies 5 and 6 coincide with the center C2 of the body to be struck 2.

The center C3 of the vibration sensor 3 and the centers C5 and C6 of the first and second elastic bodies 5 and 6 may be positioned offset from the center C2 of the body to be struck 2, for example. Further, the center C5 of the first elastic body 5 and/or the center C6 of the second elastic body 6 may be positioned offset from the center C3 of the vibration sensor 3. Further, the centers C5 and C6 of the first and second elastic bodies 5 and 6 may be positioned so as to be offset from each other.

The first elastic body 5 is bonded to the vibration sensor 3 and the body to be struck 2, respectively. In this embodiment, the entire region of the first facing surface 5*a* of the first elastic body 5 facing the vibration sensor 3 is bonded to the vibration sensor 3. Further, the entire region of the second facing surface 5*b* of the first elastic body 5 facing the body to be struck 2 is bonded to the body to be struck 2. The second elastic body 6 is bonded to the vibration sensor 3 and the support base 4, respectively. In this embodiment, the entire region of the first facing surface 6*a* of the second elastic body 6 facing the vibration sensor 3 is bonded to the vibration sensor 3. Further, the entire region of the second facing surface 6*b* of the second elastic body 6 facing the support base 4 is bonded to the support base 4. The adhesive layer (not shown) for adhering the first and second elastic bodies 5 and 6 to the body to be struck 2, the vibration sensor 3, and the support base 4 may be an adhesive, a double-sided tape, or the like.

In the impact detection device 1 of this embodiment, when the body to be struck 2 is struck, the vibration of the body to be struck 2 is transmitted to the vibration sensor 3 via the first elastic body 5. Further, the vibration of the body to be struck 2 is transmitted to the vibration sensor 3 via the support base 4 and the second elastic body 6. As a result, the vibration sensor 3 vibrates and outputs a signal corresponding to the vibration, and a sound source unit (not shown) processes the output signal from the vibration sensor 3 and outputs the sound signal to a speaker (not shown). The speaker emits a sound corresponding to the sound signal.

As described above, according to the impact detection device 1 of this embodiment and the percussion instrument 100 including the impact detection device 1, the vibration sensor 3 is sandwiched between the body to be struck 2 and the support base 4 via the first elastic body 5 and the second elastic body 6. As a result, the vibration sensor 3 can be held with respect to the body to be struck 2.

Further, in the impact detection device 1 and the percussion instrument 100 of this embodiment, the dimensions of the first elastic body 5 and the second elastic body 6 as seen from the arrangement direction of the first elastic body 5, the vibration sensor 3, and the second elastic body 6 are smaller than the dimension of the vibration sensor 3. That is, the vibration sensor 3 has a portion that is not sandwiched between the first elastic body 5 and the second elastic body 6. Therefore, it is possible to prevent the vibration of the vibration sensor 3 accompanying an impact on the body to be struck 2 from being restricted by the first and second elastic bodies 5 and 6. That is, the degree of freedom of vibration of the vibration sensor 3 can be improved. In particular, the sensitivity of the vibration sensor 3 to high frequency vibration can be improved. As a result, a higher frequency signal is input from the vibration sensor 3 to the sound source unit, so that the response speed in the sound source unit can be improved. That is, it is possible to suppress a time lag between striking the body to be struck 2 and emitting a sound in the speaker.

Further, since vibration in a wider frequency band is detected by the vibration sensor 3, the information obtained from the vibration sensor 3 increases, so that it is possible to correspond to various musical expressions. For example, by detecting the vibration in a wide frequency band by the vibration sensor 3, a difference is likely to appear in the vibration waveform detected by the vibration sensor 3 depending on the striking position on the striking surface 2*a* of the body to be struck 2. This makes it possible to estimate the striking position on the striking surface 2*a* of the body to be struck 2. By being able to estimate the striking position, for example, different sound signals can be output to the speaker depending on the striking position.

Further, in the impact detection device 1 of this embodiment, the support base 4 is fixed to the body to be struck 2. As a result, vibration in a wider frequency band can be detected by the vibration sensor 3. Further, since the body to be struck 2 and the support base 4 are (directly) connected with each other without sandwiching a separate member therebetween, the impact detection device 1 and the percussion instrument 100 can be compactly configured.

Moreover, in the impact detection device 1 of this embodiment, the body to be struck 2 includes the elastic sheet portion 21 made of an elastic body, and the support plate portion 22 that has a higher elastic modulus than the elastic sheet portion 21 and is overlaid on the elastic sheet portion 21 in the thickness direction thereof. As a result, vibration in a wider frequency band can be detected by the vibration sensor 3.

Further, in the impact detection device 1 of this embodiment, the center C3 of the vibration sensor 3, the center C5 of the first elastic body 5, and the center C6 of the second elastic body 6 coincide with each other when viewed from the arrangement direction of the first elastic body 5, the vibration sensor 3, and the second elastic body 6. Therefore, when the vibration sensor 3 is sandwiched between the first elastic body 5 and the second elastic body 6, it is possible to prevent the vibration sensor 3 from tilting and coming into contact with the body to be struck 2 or the support base 4. That is, the vibration sensor 3 can be stably sandwiched between the first elastic body 5 and the second elastic body 6.

Moreover, in the impact detection device 1 of this embodiment, the center C3 of the vibration sensor 3 and the centers C5 and C6 of the first and second elastic bodies 5 and 6 coincide with the center C2 of the body to be struck 2 when viewed from the arrangement direction. As a result, compared to a case where the center C3 of the vibration sensor 3 and the centers C5 and C6 of the first and second elastic bodies 5 and 6 are offset from the center C2 of the body to be struck 2, the sensitivity of the vibration sensor 3 to striking of the body to be struck 2 can be further improved.

Further, in the impact detection device 1 of this embodiment, the support base 4 is sufficiently rigid. That is, the support base 4 is less likely to be deformed than the first and second elastic bodies 5 and 6. Therefore, it is less likely for the high frequency vibration accompanying the impact on the body to be struck 2 to be absorbed by support base 4. As a result, the vibration sensor 3 can detect vibrations of higher frequencies.

Although the embodiments of the present invention have been described in detail above, the present invention is not limited to the above embodiments, and various modifications can be made without departing from the spirit of the present invention.

Figure 3:
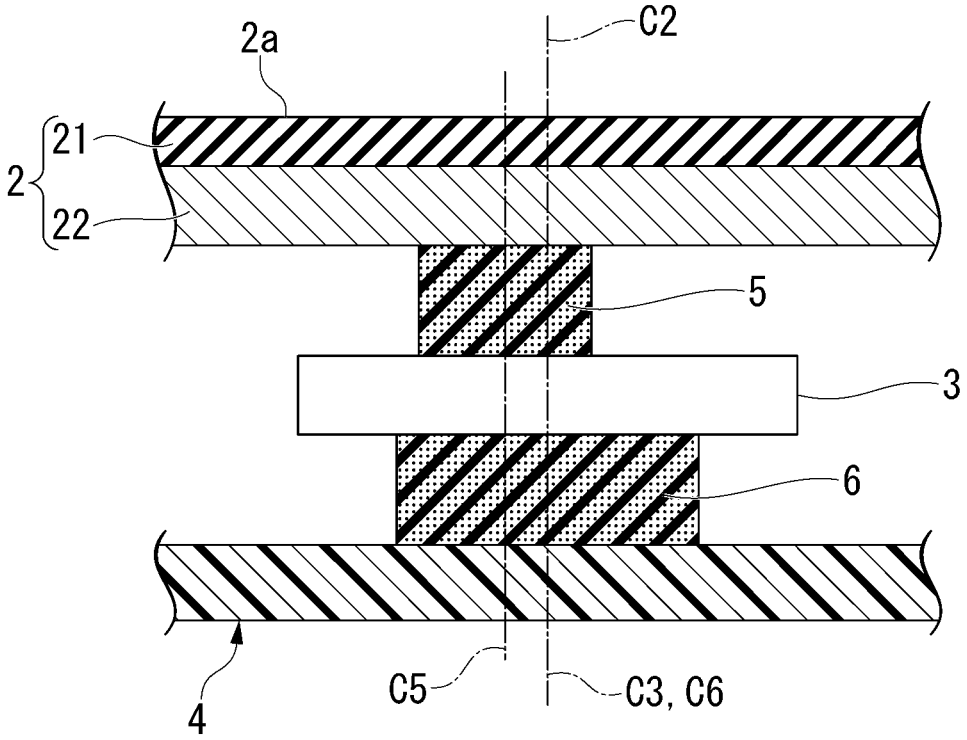
FIG. 3 is an enlarged cross-sectional view showing main parts of the impact detection device according to another embodiment of the present invention.

In some embodiments, for example, as shown in FIG. 3, the dimensions of the first elastic body 5 and the second elastic body 6 may be mutually different when viewed from the arrangement direction of the first elastic body 5, the vibration sensor 3, and the second elastic body 6. In FIG. 3, the dimension of the first elastic body 5 is smaller than the dimension of the second elastic body 6. In this case, as compared to the case where the dimensions of the first and second elastic bodies 5 and 6 are the same, then even if the centers C5 and C6 of the first and second elastic bodies 5 and 6 are positioned offset from each other when viewed from the arrangement direction of the first elastic body 5, the vibration sensor 3, and the second elastic body 6, the entire smaller elastic body (first elastic body 5 in FIG. 3) among the first and second elastic bodies 5 and 6 can be stacked on the larger elastic body (second elastic body 6 in FIG. 3). As a result, the vibration sensor 3 can be stably sandwiched between the first and second elastic bodies 5 and 6. Therefore, when the vibration sensor 3 is sandwiched between the first and second elastic bodies 5 and 6, it is possible to prevent the vibration sensor 3 from tilting and coming into contact with the body to be struck 2 or the support base 4.

Figure 4:
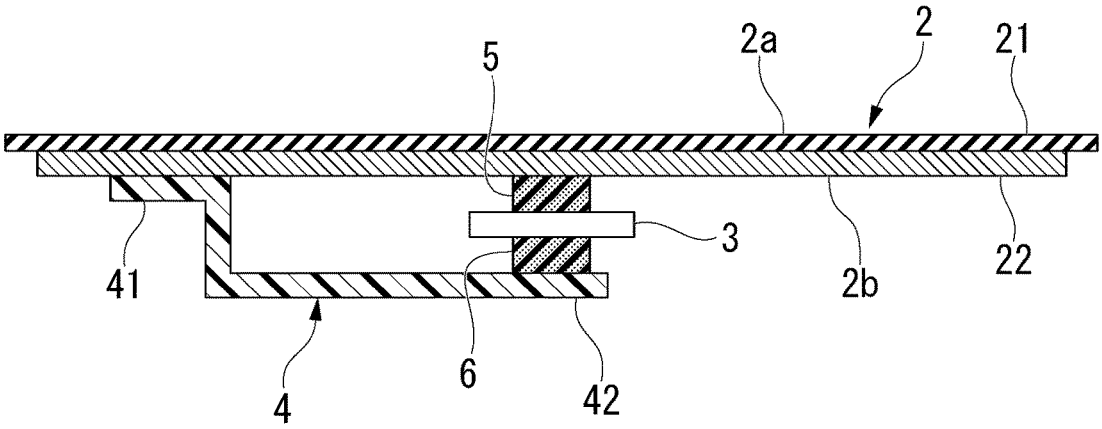
FIG. 4 is a cross-sectional view showing an outline of an impact detection device according to another embodiment of the present invention.

In some embodiments, the support base 4 may be a cantilever beam in which only a first end portion 41 in the longitudinal direction is fixed to the body to be struck 2, as shown in FIG. 4, for example. In this case, the vibration sensor 3 may be arranged at a distal end portion of the support base 4 that is spaced from the first end portion 41 in the longitudinal direction. In FIG. 4, the vibration sensor 3 is arranged at a second end 42 in the longitudinal direction of the support 4. However the vibration sensor 3 may be arranged for example at a portion of the support 4 between the first end 41 and the second end 42.

In such a configuration, as compared with the case where the support base 4 has a bowl shape or a double-sided beam as in the above embodiment, the support base 4 (particularly the portion excluding the first end portion 41) is more likely to vibrate with the vibration of the body to be struck 2. As a result, it is possible to prevent the vibration of the vibration sensor 3 accompanying an impact on the body to be struck 2 from being restricted by the support base 4. That is, the degree of freedom of vibration of the vibration sensor 3 can be further improved.

Figure 5:
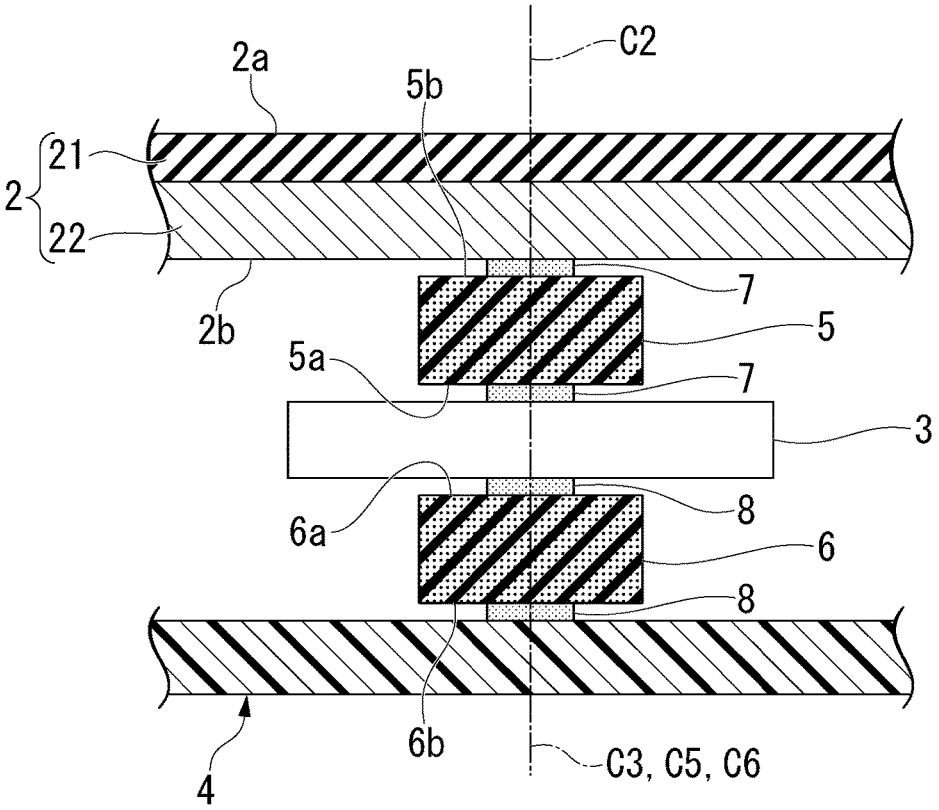
FIG. 5 is an enlarged cross-sectional view showing main parts of an impact detection device according to another embodiment of the present invention.

In some embodiments, for example, as shown in FIG. 5, only an area on a part (only a portion) of the first facing surface 5*a* of the first elastic body 5 facing the vibration sensor 3 (bonding target) may be bonded to the vibration sensor 3. Further, only an area on a part (only a portion) of the second facing surface 5*b* of the first elastic body 5 facing the body to be struck 2 (bonding target) may be bonded to the body to be struck 2.

Figure 6:
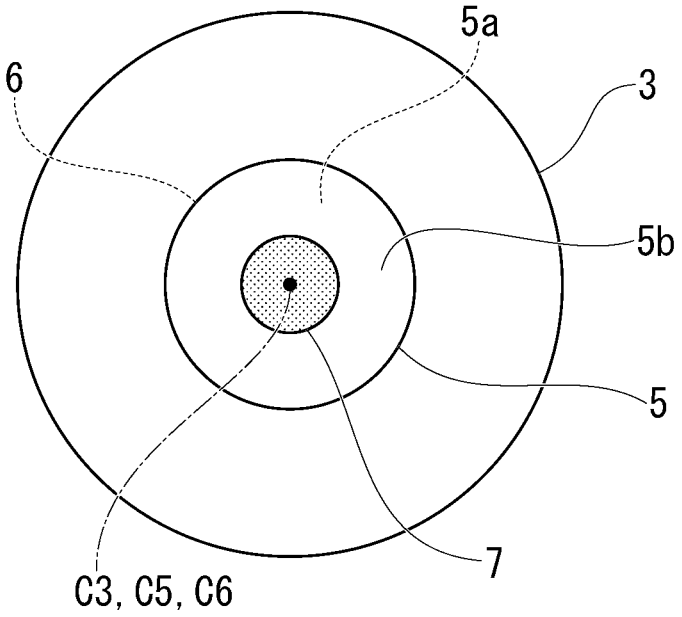
FIG. 6 is a view of a first elastic body, a vibration sensor, and a second elastic body as viewed from an arrangement direction thereof.

In the configurations illustrated in FIGS. 5 and 6, the first elastic body 5 is bonded to both of the vibration sensor 3 and the body to be struck 2 by the adhesive layers 7. The dimensions of the adhesive layers 7 as seen from the arrangement direction of the first elastic body 5, the vibration sensor 3, and the second elastic body 6 are smaller than the dimensions of the first facing surface 5*a* and the second facing surface 5*b* of the first elastic body 5.

Further, in the configuration illustrated in FIGS. 5 and 6, the adhesive layer 7 is provided in the central region of the first facing surface 5*a* of the first elastic body 5 and in the central region of the second facing surface 5*b*. As a result, only the central regions of the first facing surface 5*a* and the second facing surface 5*b* of the first elastic body 5 are bonded to the vibration sensor 3 or the body to be struck 2. On the other hand, the peripheral region of the first facing surface 5*a* and the peripheral region of the second facing surface 5*b* are not bonded to the vibration sensor 3 or the body to be struck 2. In FIG. 5, the peripheral regions of the first facing surface 5*a* and the second facing surface 5*b* of the first elastic body 5 are not in contact with the vibration sensor 3 or the body to be struck 2. However for example the peripheral regions may be in contact with the vibration sensor 3 and/or the body to be struck 2.

Figure 7:
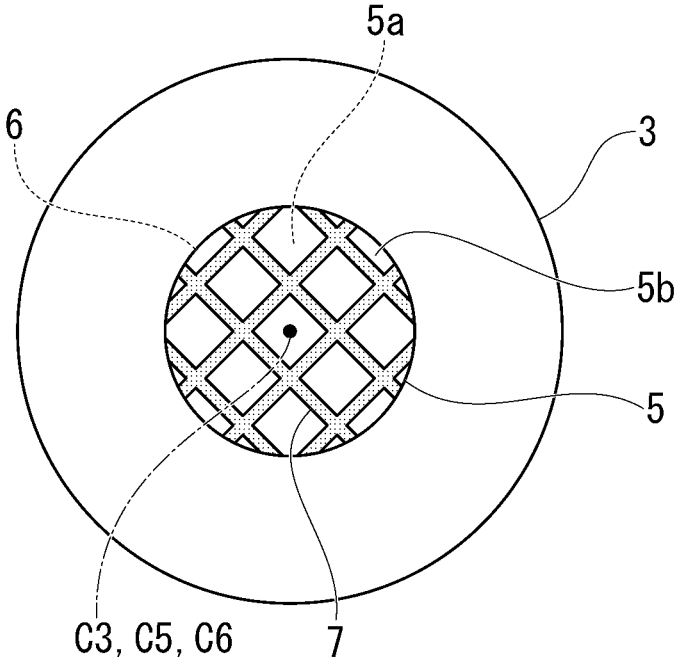
FIG. 7 is a diagram showing a modified example of FIG. 6.

The shape of the adhesive layer 7 in a plan view may be a circular shape as illustrated in FIG. 6, or may be arbitrary, for example, a polygonal shape. Further, the shape of the adhesive layer 7 in a plan view may be a grid shape or a mesh shape, as shown in FIG. 7, for example. In this case, even if the adhesive layer 7 is formed on the entire first facing surface 5*a* or on the entire second facing surface 5*b* of the first elastic body 5, only an area on a part of the first facing surface 5*a* or second facing surface 5*b* of the first elastic body 5 can be bonded to the vibration sensor 3 and the body to be struck 2.

In some embodiments, for example, as shown in FIG. 5, only an area on a part of the first facing surface 6*a* of the second elastic body 6 facing the vibration sensor 3 may be bonded to the vibration sensor 3. Further, only an area on a part of the second facing surface 6*b* of the second elastic body 6 facing the support base 4 (bonding target) may be bonded to the support base 4.

In the configuration illustrated in FIG. 5, the second elastic body 6 is bonded to both of the vibration sensor 3 and the support base 4 by adhesive layers 8. The dimensions of the adhesive layers 8 as seen from the arrangement direction are smaller than the dimensions of the first facing surface 6*a* and the second facing surface 6*b* of the second elastic body 6. Further, similarly to the first elastic body 5, only the central region of the first facing surface 6*a* of the second elastic body 6 and the central region of the second facing surface 6*b* of the second elastic body 6 are bonded to the vibration sensor 3 and the support base 4, and the peripheral region of the first facing surface 6*a* and the peripheral region of the second facing surface 6*b* are not bonded to the vibration sensor 3 or the support base 4. In FIG. 5, the peripheral regions of the first facing surface 6*a* and the second facing surface 6*b* of the second elastic body 6 are not in contact with the vibration sensor 3 or the support base 4. However for example the peripheral regions may be in contact with the vibration sensor 3 and/or the support base 4. The plan-view shape of the adhesive layers 8 used for adhering the second elastic body 6 may be the same as that of the adhesive layers 7 used for adhering the first elastic body 5.

As illustrated in FIGS. 5 to 7, in the case where only an area on a part of the first facing surface 5*a* of the first elastic body 5 is bonded to the vibration sensor 3, and/or only an area on a part of the first facing surface 6*a* of the second elastic body 6 is bonded to the vibration sensor 3, then compared to the case where the entire first facing surfaces 5*a* and 6*a* of the first elastic body 5 and the second elastic body 6 are bonded to the vibration sensor 3, it is possible to prevent the vibration of the vibration sensor 3 accompanying an impact on the body to be struck 2 from being restricted by the first and second elastic bodies 5 and 6. That is, the degree of freedom of vibration of the vibration sensor 3 can be further improved.

Further, in a case where only an area on a part of the second facing surface 5*b* of the first elastic body 5 facing the body to be struck 2 is bonded to the body to be struck 2, then compared to the case where the entire second facing surface 5*b* of the first elastic body 5 is bonded to the body to be struck 2, it is possible to prevent the vibration of first elastic body 5 accompanying an impact on the body to be struck 2 from being restricted by the body to be struck 2. As a result, the vibration accompanying an impact on the body to be struck 2 can be efficiently transmitted from the body to be struck 2 to the vibration sensor 3 through the first elastic body 5.

Further, in a case where only an area on a part of the second facing surface 6*b* of the second elastic body 6 facing the support base 4 is bonded to the support base 4, then compared to the case where the entire second facing surface 6*b* of the second elastic body 6 is bonded to the support base 4, it is possible to prevent the vibration of the second elastic body 6 accompanying an impact on the body to be struck 2 from being restricted by the support base 4. As a result, the vibration accompanying an impact on the body to be struck 2 can be efficiently transmitted from the support base 4 to the vibration sensor 3 through the second elastic body 6.

In some embodiments, for example, only one of the first elastic body 5 and the second elastic body 6 may be bonded to the vibration sensor 3, and the other may not be bonded to the vibration sensor 3.

According to some embodiments of the present invention, the vibration sensor can be held with respect to the body to be struck, and the degree of freedom of vibration of the vibration sensor accompanying an impact on the body to be struck can be improved.

What is claimed is:

1. An impact detection device comprising:

an elastic sheet portion configured to be struck;

a support plate portion in contact with one side of the elastic sheet portion;

a vibration sensor that detects vibration of the support plate portion;

a support base fixed to the support plate portion and that supports the vibration sensor, and configured to transmit the vibration of the support plate portion;

a first elastic body sandwiched between the vibration sensor and the support plate portion, and configured to transmit the vibration of the support plate portion to the vibration sensor; and a second elastic body sandwiched between the vibration sensor and the support base, and configured to transmit the vibration of the support plate portion transmitted from the support base to the vibration sensor, wherein a dimension of each of the first elastic body and the second elastic body is smaller than a dimension of the vibration sensor as viewed from an arrangement direction in which the first elastic body, the vibration sensor, and the second elastic body are arranged, wherein the support base is provided with a cantilever beam configuration where only one end portion of the support base in a longitudinal direction thereof is fixed to the support plate portion, and wherein the vibration sensor is arranged at a distal end portion of the support base that is spaced from the one end portion of the support base in the longitudinal direction.

2. The impact detection device according to claim 1, wherein:

the elastic sheet portion is overlaid on the support plate portion, which has a higher elastic modulus than the elastic sheet portion, and the elastic sheet portion includes a third elastic body.

3. The impact detection device according to claim 1, wherein a center of the vibration sensor, a center of the first elastic body, and a center of the second elastic body coincide with each other as viewed from the arrangement direction.

4. The impact detection device according to claim 1, wherein the dimensions of the first elastic body and the second elastic body are equal to each other as viewed from the arrangement direction.

5. The impact detection device according to claim 1, wherein the dimension of the first elastic body is smaller than the dimension of the second elastic body as viewed from the arrangement direction.

6. The impact detection device according to claim 1, wherein only a portion of a surface of the first elastic body is bonded to one of the vibration sensor or the support plate portion.

7. The impact detection device according to claim 1, wherein only a portion of a surface of the second elastic body is bonded to one of the vibration sensor or the support base.

8. The impact detection device according to claim 1, wherein the support plate portion is a metal plate.

9. The impact detection device according to claim 1, wherein the support base:

includes a first side and a second side opposite the first side;

supports the vibration sensor only from the first side so that the vibration sensor is entirely disposed between the first side of the support base and the support plate portion.

10. A percussion instrument comprising:

a support member; and an impact detection device resting on the support member and comprising:

an elastic sheet portion configured to be struck;

a support plate portion in contact with one side of the elastic sheet portion;

a vibration sensor that detects vibration of the support plate portion;

a support base fixed to the support plate portion and that supports the vibration sensor, and configured to transmit the vibration of the support plate portion;

a first elastic body sandwiched between the vibration sensor and the support plate portion, and configured to transmit the vibration of the support plate portion to the vibration sensor; and a second elastic body sandwiched between the vibration sensor and the support base, and configured to transmit the vibration of the support plate portion transmitted from the support base to the vibration sensor, wherein a dimension of each of the first elastic body and the second elastic body is smaller than a dimension of the vibration sensor as viewed from an arrangement direction in which the first elastic body, the vibration sensor, and the second elastic body are arranged, wherein the support base is provided with a cantilever beam configuration where only one end portion of the support base in a longitudinal direction thereof is fixed to the support plate portion, and wherein the vibration sensor is arranged at a distal end portion of the support base that is spaced from the one end portion of the support base in the longitudinal direction.

11. The percussion instrument according to claim 10, wherein the support plate portion is a metal plate.

12. The percussion instrument according to claim 10, wherein the support base:

includes a first side and a second side opposite the first side;

supports the vibration sensor only from the first side so that the vibration sensor is entirely disposed between the first side of the support base and the support plate portion.

* * * * *